United States Patent [19]

Lederer

[11] 4,331,194

[45] May 25, 1982

[54] KEY HOLDER

[76] Inventor: Richard J. Lederer, 3496 Regent Dr., Palatine, Ill. 60067

[21] Appl. No.: 188,333

[22] Filed: Sep. 18, 1980

[51] Int. Cl.[3] ..... A45C 11/42

[52] U.S. Cl. ..... 150/40; 206/37

[58] Field of Search ..... 150/40; 206/37; 70/456 R

[56] References Cited

U.S. PATENT DOCUMENTS

| | | | |
|---|---|---|---|
| 1,877,912 | 9/1932 | L'enfant | 150/40 |
| 2,703,596 | 3/1955 | Kromer | 150/40 |
| 2,756,794 | 7/1956 | Buckett | 150/40 |
| 2,915,099 | 12/1959 | Gates | 150/40 |
| 4,037,716 | 7/1977 | Marks | 150/40 X |

*Primary Examiner*—Donald F. Norton

*Attorney, Agent, or Firm*—Gary, Juettner & Pyle

[57] ABSTRACT

A portable, credit card size, holder for keys and the like comprises a laminated assembly having two plies of thermoplastic film sealed together at their marginal edges; and in its preferred embodiment, having a flat card-like insert, slightly smaller in area than the plies of film, having a main body and two spaced apart end portions on one face of the main body, the insert being sandwiched between the plies of film; the ply of film contiguous to said end portions having a pair of slits therein, aligned respectively with the free edges of the end portions, thereby forming two end pockets accommodating insertion of keys for secure, but removable retention of the keys by the laminated assembly.

4 Claims, 2 Drawing Figures

KEY HOLDER

CROSS REFERENCE

The invention illustrated and described herein is the subject of invention disclosure document Ser. No. 090,759, filed May 13, 1980.

BACKGROUND OF THE INVENTION

Many people like to carry, in a secure place on their person, spare keys for important locks, such as home and car, so they will not be locked out if their key ring or key case is lost or stolen. Sportsmen and hikers desire to secure their keys in a safe place while fishing, hunting or hiking, but key rings and key cases are often cumbersome and troublesome. Travelers like to carry a spare set of car keys on their person, separate from their own keys, so that if the main set of keys is lost or stolen, they will still have access to and use of their cars.

To solve these common problems, card size holders for keys have been developed to allow people to keep their spare keys in their wallets; for example, the device shown in U.S. Pat. No. 4,037,716. There, the patentee has proposed a device comprising a rigid base having a depressed region for receiving keys and a pressure sealable/resealable lid. This device is fairly elaborate, requires several steps to manufacture, and as a result, is relatively expensive. The lid of the holder consists of a thin plastic membrane which can be easily damaged and is quite susceptible to wear and loss of its adhesiveness to the base. The keys are not individually secured, but are permitted to rattle around in the holder, increasing the likelihood that the keys may slip under the lid, fall out and become lost. It would be desirable to have a device which could be inexpensively manufactured, which would individually secure the keys, and which would have a long useful life.

SUMMARY OF THE INVENTION

In order to overcome the attendant disadvantages of the prior art holders, the present invention provides a credit card size holder for keys and the like comprising a laminated assembly having two plies of thermoplastic film sealed together at their marginal edges. One of the plies of film has two spaced apart transverse slits therein, thus forming two opposing pockets at the ends of the laminated assembly. The pockets accommodate insertion of keys for secure, but removable retention of the keys by the laminated assembly.

The laminated plies of film provide a durable assembly for the individual retention of keys. The plies of film of the invention are thicker and therefore more durable than the thin plastic membrane lid of the prior art. The film, due to its resilient properties, retracts over the keys, securing them individually by frictional and compression forces. The keys are not permitted to rattle around in the assembly. Thus, the potential for loss of the keys or damage to the keys or card holder is greatly reduced.

In the preferred embodiment of the key holder of the invention, a card-like insert is sandwiched between the two plies of thermoplastic film. The insert has a main body and two spaced apart end portions on one face of the main body. The ply of film having the two slits therein is contiguous to said end portions. The free edges of the end portions are aligned, respectively, with the slits. The insert is preferably integral, with the end portions being folded over the opposed edges of the main body. The ply of film contiguous to the end portions is heat sealed to the end portions and is also heat sealed to the main body between the end portions. The other ply of film is heat sealed to the back of the main body. Thus, opposing end pockets are formed between the main body and the end portions of the insert. The pockets accommodate insertion of keys of secure, but removable retention of the keys by the laminated assembly.

The insert, while not required, improves the operation of the invention. The insert stiffens the laminated assembly, making the invention more durable. The insert, when made of paper or a similar material with a greater coefficient of friction than plastic, increases the frictional forces retaining the keys. Also, when the insert is incorporated in the lamination, the entire assembly may be pressed in a heat sealing laminator, as opposed to just sealing the marginal edges. This, in turn, simplifies the manufacturing process. Also, when used with clear plastic plies, the insert provides a convenient printing surface for instructions and promotional messages.

The holder of the invention is operated by lifting open one of the pockets at the slit with one's thumb nail. One end of a key may then be inserted into the pocket. If the key is long enough, the opposite end of the key may then be slid into the opposing pocket by the same method. The thermoplastic film retracts over the key upon release. Additional keys may be accommodated in the same manner. The keys are thereby individually held securely in position, thus preventing their loss. The keys may be removed simply by extracting them from the pockets.

The present invention does not incorporate an adhesive lid, nor any other means that will deteriorate with use, and is very easy and economical to manufacture.

Other objects, advantages and uses of the invention will become apparent from the following detailed description, taken in conjunction with the accompanying drawing.

DETAIL DESCRIPTION

Figure 1:
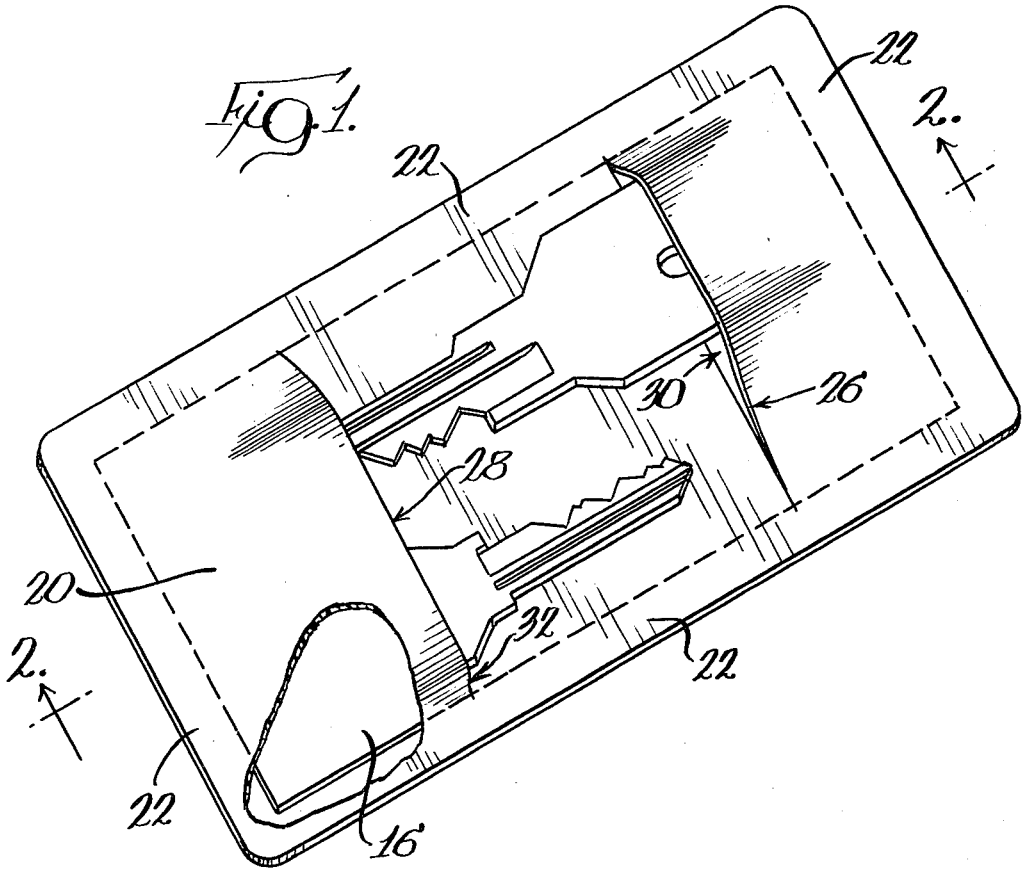
FIG. 1 is an isometric view of the preferred embodiment of the key holder of the invention, illustrating two keys held securely in the pockets.
Figure 2:
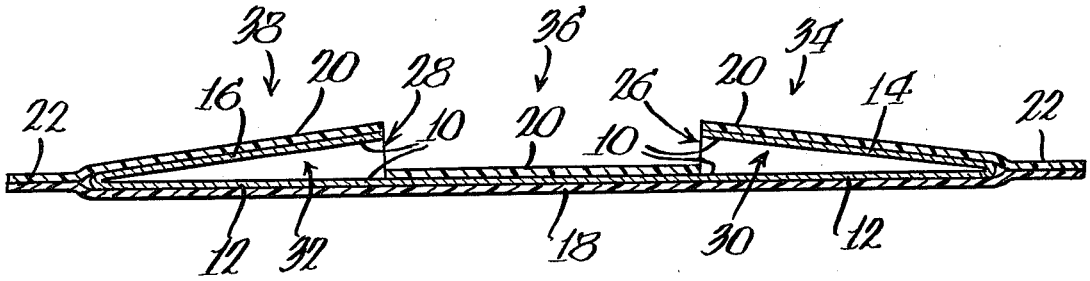
FIG. 2 is a cross-sectional view taken substantially on line 2—2 of FIG. 1 and illustrating the lamination of the thermoplastic plies and the insert and, in slightly exaggerated form, the pockets formed thereby to retain the keys.

Referring to the drawings, the key holder of the invention comprises a laminated assembly of a back ply of thermoplastic film 18 and a front ply of thermoplastic film 20. The two plies may for convenience be formed from a single sheet folded in half to form a pouch. The back ply of film 18 is preferably imperforate. The front ply of film 20 has an upper slit 26 and a lower slit 28, said slits 26 and 28 extending almost, but not quite, to the marginal edges of the ply. The front ply of film 20 is thereby divided into three sections; upper 34, middle 36 and lower 38. The upper section 34 is preferably of a length in the order of 20% to 25% of the length of said laminated assembly. The lower section 38 is preferably of a length in the order of 30% to 40% of the length of said laminated assembly. The front ply of film 20 and the back ply of film 18 are heat sealed together at their marginal edges 22, and if desired at the middle portion 36, thereby forming an upper pocket 30 and a lower pocket 32.

In the preferred embodiment of the invention, a flat card like insert 10, smaller in area than said plies of thermoplastic film, is sandwiched between said plies. The insert 10 has a main body 12 and, on the front side of said main body, an upper end portion 14 and a lower end portion 16. The insert 10 is preferably integral, wherein the end portions 14 and 16 are formed by folding over opposing edge portions of the main body 12. The free edge of the upper end portion 14 is aligned with the upper slit 26. Similarly, the free edge of the lower end portion 16 is aligned with the lower slit 28.

The middle section 36 of the front ply of film 20 is heat sealed to the front face of the main body 12 between said end portions. The upper section 34 and lower section 38 of the front ply 20 are heat sealed to the upper end portion 14 and lower end portion 16, respectively. The back ply of film 18 is heat sealed to the back face of the main body 12. Thereby, the upper pocket 30 is formed between the main body 12 and the upper end portion 14, and the opposing lower pocket 32 is formed between the main body 12 and the lower end portion 16.

The plies of film 18 and 20 may be cut to size from plastic sheet, preferably a resilient plastic capable of being heat sealed, such as polyethylene. While any relatively thin plastic film is acceptable, the preferred range of film thicknesses is 0.003 to 0.010 mils, with 0.007 mil polyethylene film having been found to produce excellent results. The insert 10 may be cut from paper stock, cloth or plastic sheet, paper stock being preferable.

The holder may be made in any size desired, depending upon the number of keys to be stored, and may, for example, be made in one size for men's wallets and another size for ladies' purses. However, the preferred size is that of a conventional plastic credit card, i.e., approximately three and one-quarter inches by two and one-eighth inches, to hold at least two keys.

The holder is manufactured with complete efficiency and economy simply by placing the insert into the pouch formed by the folded and pre-slit sheet of plastic film and running the same through a conventional card laminator, whereby the same is formed into an integral laminated assembly, with the film laminated to itself and the insert, and with the insert automatically defining the two pockets 30 and 32.

By forming the assembly from transparent film, the exposed surfaces of the insert can be utilized (prior to lamination) for reception of printed instructions, messages, promotional material and/or advertising. Additional esthetic values can be achieved by use of variously colored films and inserts.

In use, the user simply opens up one of the pockets, by inserting a finger or thumb nail through the respective slit, and inserts one end of the key in the pocket. Upon release, the film resiliently biases the material of the insert around the key thereby compressively and frictionally locking the key in the pocket. If the key is small, it is securely maintained by insertion in just one of the pockets, preferably the larger pocket as shown at the lower side of FIG. 1. If the key is fairly large, one end is preferably inserted in one pocket and the opposite end in the other pocket, whereby the key is securely retained by the holder. To remove one of the keys, the same is merely extracted from the pocket or pockets by sliding the same outwardly parallel to the plane of the card.

The key holder of the invention thus provides for secure but removable retention of keys in a credit card size laminated assembly of particular usefulness, economy and longevity of service.

While a preferred embodiment of the invention has been illustrated and described, it is to be appreciated that changes, variations and modifications may be made therein without departing from the scope of the invention as defined in the appended claims.

What is claimed is:

1. A portable card holder for keys and the like comprising a laminated assembly of two plies of thermoplastic film sealed together at their marginal edges, one ply of film having a pair of spaced apart transverse slits therein, and a flat card-like insert having a main body and spaced apart end portions on one face of said main body sandwiched between said two plies of thermoplastic film, said end portions being contiguous to said ply of film having said slits therein, the free edges of said end portions being aligned respectively with said slits, thereby forming two opposing end pockets accommodating insertion of keys through said slits into said end pockets for secure, but removable retention of the keys by said laminated assembly.

2. A card holder as set forth in claim 1, wherein said insert is sealed to said plies of thermoplastic film.

3. A card holder as set forth in claim 1, wherein said insert is integral and said end portions are folded over opposed edges of said main body.

4. A card holder as set forth in claim 1, wherein one of said pair of spaced apart transverse slits is positioned at about 20% to 25% of the length of said laminated assembly from one end of said laminated assembly, and the other slit is positioned at about 30% to 40% of the length of said laminated assembly from the other end of said laminated assembly.

* * * * *